US005549503A

United States Patent [19]

Nauche et al.

[11] Patent Number: 5,549,503

[45] Date of Patent: Aug. 27, 1996

[54] OPHTHALMIC LENS GRINDING MACHINE

[75] Inventors: Michel Nauche, Soisy S/Montmorency; Laurent Guillermin, Paris, both of France

[73] Assignee: Essilor International, France

[21] Appl. No.: 179,487

[22] Filed: Jan. 7, 1994

[30] Foreign Application Priority Data

Jan. 8, 1993 [FR] France ..... 93 00130

[51] Int. Cl.[6] ..... B24B 17/00

[52] U.S. Cl. ..... 451/11; 451/43; 451/255; 451/251

[58] Field of Search ..... 451/1, 5, 9, 11, 451/14, 43, 255, 256, 251, 228

[56] References Cited

U.S. PATENT DOCUMENTS

| | | | |
|---|---|---|---|
| 4,596,091 | 6/1986 | Daboudet et al. | 451/43 |
| 5,398,460 | 3/1995 | Joncour | 451/2 |

FOREIGN PATENT DOCUMENTS

| | | | |
|---|---|---|---|
| 360669 | 3/1990 | European Pat. Off. . | |
| 177402 | 4/1986 | France . | |
| 1193160 | 8/1989 | Japan | 451/43 |

OTHER PUBLICATIONS

Japan Abstract, vol. 17, No. 139 (M-1385) 22 Mar. 1993.

Japan Abstract, 43 15 563 (NIKON CO.) 6 Nov. 1992.

*Primary Examiner*—Robert A. Rose

*Attorney, Agent, or Firm*—Quarles & Brady

[57] ABSTRACT

A machine for grinding ophthalmic lenses includes a motor driven grinding wheel, a swinging head frame for holding ophthalmic lens and rotating the lenses into and out of contact with the grinding wheel, and a veneer positively connected to the swinging head frame by a positive linkage to prevent separation of the swinging head frame from the controlling veneer and thereby avoid the introduction of errors into the position of the lens relative to the control position of the veneer.

18 Claims, 3 Drawing Sheets

PRIOR
ART

OPHTHALMIC LENS GRINDING MACHINE

BACKGROUND OF THE INVENTION

The present invention relates to a machine for grinding the circumference of ophthalmic lenses.

Grinding machines already exist for use in the ophthalmic field for edging, bevelling or grooving ophthalmic lenses. Edging is an operation which enables the outer contour or circumference of an ophthalmic lens, which is generally circular in shape, to be matched to the contour of the frame into which the lens is to be fitted. The operation thus consists in removing certain portions of the lens periphery.

Bevelling of an ophthalmic lens, which is carried out after edging, enables the transverse cross-section of the peripheral edge of the lens to be matched to the shape of the groove normally provided in spectacle frames in order that the lens may be fitted thereinto. Bevelling thus consists of providing a rib or bevel of a generally triangular shape on the outer edge of the lens.

Grooving of an ophthalmic lens is an operation which is also carried out after edging of the lens. Its purpose is to adapt the cross-section of the outer edge of the lens in order that the lens can be fitted into certain types of frame. Indeed, certain frames are not provided with a groove over the whole inner perimeter of the frame; thus, for, example, the frame may only correspond to the upper portion of the lens whereas the lower portion of the lens is only held in place by means of a transparent filament. In this case, it is necessary to provide a groove or channel, most frequently of a triangular or semi-circular cross-section, on the outer edge of the lens.

Most frequently, these three operations are carried out on a single grinding machine fitted with a set of grinding wheels. Such machines are known and are available commercially. One such example is described in French patent No. 2,543,039 in the name of the present applicant, equivalent to U.S. Pat. No. 4,596,091.

These grinding machines generally consist of a frame carrying, firstly, one or several diamond tipped grinding wheels often linked together to constitute a grinding wheel train, and rotatably mounted about an axis, and, secondly, a swinging head frame for carrying the lens. This head frame is fitted with gripping means adapted to receive, retain and rotate the ophthalmic lens to be processed. In such a grinding machine, the head frame and the grinding wheel or wheels are adapted to move relative to each other firstly in the direction of the grinding wheel axis (axial movement) and, secondly, substantially perpendicularly to said axis (so-called orthoradial movement). Relative axial movement enables changeover from one grinding wheel to another to be achieved as well as enabling the contour of the lens circumference to be followed during bevelling or grooving operations. Substantially orthoradial relative movement enables lenses which are non-circular in shape to be machined. This present invention relates to the substantially orthoradial movement of the swinging head frame with respect to the grinding wheels in a grinding machine.

Most frequently, the grinding wheel or wheels are rotatably mounted on a first axis and the head frame is slidably and pivotally mounted about a second axis parallel to the first axis. The head frame is sometimes also mounted so as to move perpendicularly to the axis of the grinding wheel or wheels.

In known machines, pressing means urge the head frame towards the grinding wheel axis. These pressing means rely on gravity alone or the combined effect of gravity and means such as springs or a counterweight system. Thus, in the Applicant's patent cited above, the pressing means urging the head frame towards the grinding wheel axis rely on the effect of gravity and a spring having adjustable tension.

In conventional machines, a template having the desired final shape of the lens is simultaneously mounted with the lens on the axis of rotation thereof. A vernier is mounted so as to be immovable with respect to the grinding wheel axis, and includes a feeler at its end enabling the point when the vernier comes in contact with the template to be determined. In more recent machines, the template is replaced by a disk and the vernier moves substantially along its horizontal axis as a function of the shape of the lens to be obtained. A feeler provided at the end of the vernier similarly allows the point when the vernier comes into contact with the disk to be determined. In both cases, when the feeler of the vernier comes into contact with the template or the disk at a given angular position of the lens, this means that machining is completed in this angular position.

Thus, during the whole machining operation, in other words during edging, bevelling or grooving, the lens is in abutment with one of the grinding wheels, under the action of the pressing means. Contact between the feeler of the vernier and the template or disk enables the precise moment at which machining is terminated to be determined at each angular position.

This system according to the prior art suffers from certain disadvantages. Firstly, the head frame is simply supported by the lens resting on the grinding wheel during use, under the action of the pressing means. Because of this, there is a danger that the head frame can be subject to uncontrollable vibrations which the pressing means, simply consisting of the force of gravity or the force provided by elastic urging means or counterweights are not able to eliminate.

Moreover, the pressing means apply a constant force to the lens in the case of a counterweight, and a force that is substantially constant when an elastic spring means is used. This may, in the case of high-power plastic material lenses, lead to a force that is too high being exercised on the grinding wheel causing the motor to come to a standstill. In the case of very thin lenses, the opposite applies and this constant load may be too high causing the lens to shatter.

Moreover, known systems necessitate complicated and somewhat irrational machining cycles to be employed. Thus, one machining mode consists in selecting one direction of rotation of the lens, and in changing the direction of rotation each time the feeler on the vernier comes in contact with the template or disk.

Finally, because of its very construction, this type of system is intrinsically limited as regards its accuracy due to the need for the feeler provided at the end of the vernier to travel a certain minimum distance before an output signal is issued from the detection means associated therewith.

SUMMARY OF THE INVENTION

The present-invention enables these disadvantages to be overcome. It provides a solution to the problems of vibration, axial play and rebound due to the pressing means or the vernier feeler. It enables machining to be adapted to the type of glass being worked, without the need to adjust the grinding machine. It provides faster and more accurate machining without the need, as is the case with known systems, for counterweights or large springs.

The invention thus provides a machine for grinding ophthalmic lenses comprising one or several grinding wheels rotatably mounted on a grinding wheel axis and driven by a motor, a swinging head frame pivotally mounted on a head frame axis parallel to said grinding wheel axis, said swinging head frame comprising means for gripping and retaining an ophthalmic lens and causing said lens to rotate about a lens axis, said head frame axis being located with respect to said grinding wheel axis so that said swinging head frame is able to bring said ophthalmic lens in contact with said grinding wheels, a vernier for controlling the angular position of said swinging head frame with respect to said head frame axis, said vernier being connected to said swinging head frame by means of a positive linkage, said vernier controlling the angular position of said swinging head frame by undergoing movements substantially along its longitudinal axis, as a function of the angular position of said gripping means with respect to said lens axis.

According to one preferred feature, the head frame is able to slide along the head frame axis and the said positive linkage determines the angular position of the head frame during sliding movement thereof along the head frame axis.

In one embodiment, the positive linkage includes a slotted part incorporating an oblong slot in which a disk mounted on the head frame engages.

In this embodiment, the said disk is preferably mounted on the axis of the gripping means, and the disk preferably moves inside the slotted part during sliding motion of the head frame along the head frame axis.

preferably, the grinding machine further comprises means for evaluating the thickness of the lens, wherein the movement of the motor driving the vernier is controlled as a function of data sent by the evaluation means.

In another embodiment, the vernier comprises a rod linked at one of the ends thereof to the head frame, a screw jacking means linked to the other end of the rod, and a motor adapted to drive the screw jacking means.

In this case, the motor adapted to drive the screw jacking means is mounted on the frame of the grinding machine by a swivel joint able to pivot about an axis parallel to the axis of the head frame, the axis of the grinding wheel and the axis of the lens.

preferably, the end of said rod is linked to the head frame by a swivel joint pivoting about a shaft fixed to the head frame.

According to another preferred feature, the motor adapted to drive the screw jacking means is controlled as a function of the angular position of the gripping means and the shape to be imparted to the lens.

The torque of the motor driving the screw jacking means is also preferably regulated as a function of the torque of the motor driving the grinding wheels.

Further aims, advantages and features of the invention will become more clear from the description that follows that follows of two embodiments of the invention provided by way of non-limiting example with reference to the attached drawings.

DETAILED DESCRIPTION OF REFERRED EMBODIMENTS

Figure 1:
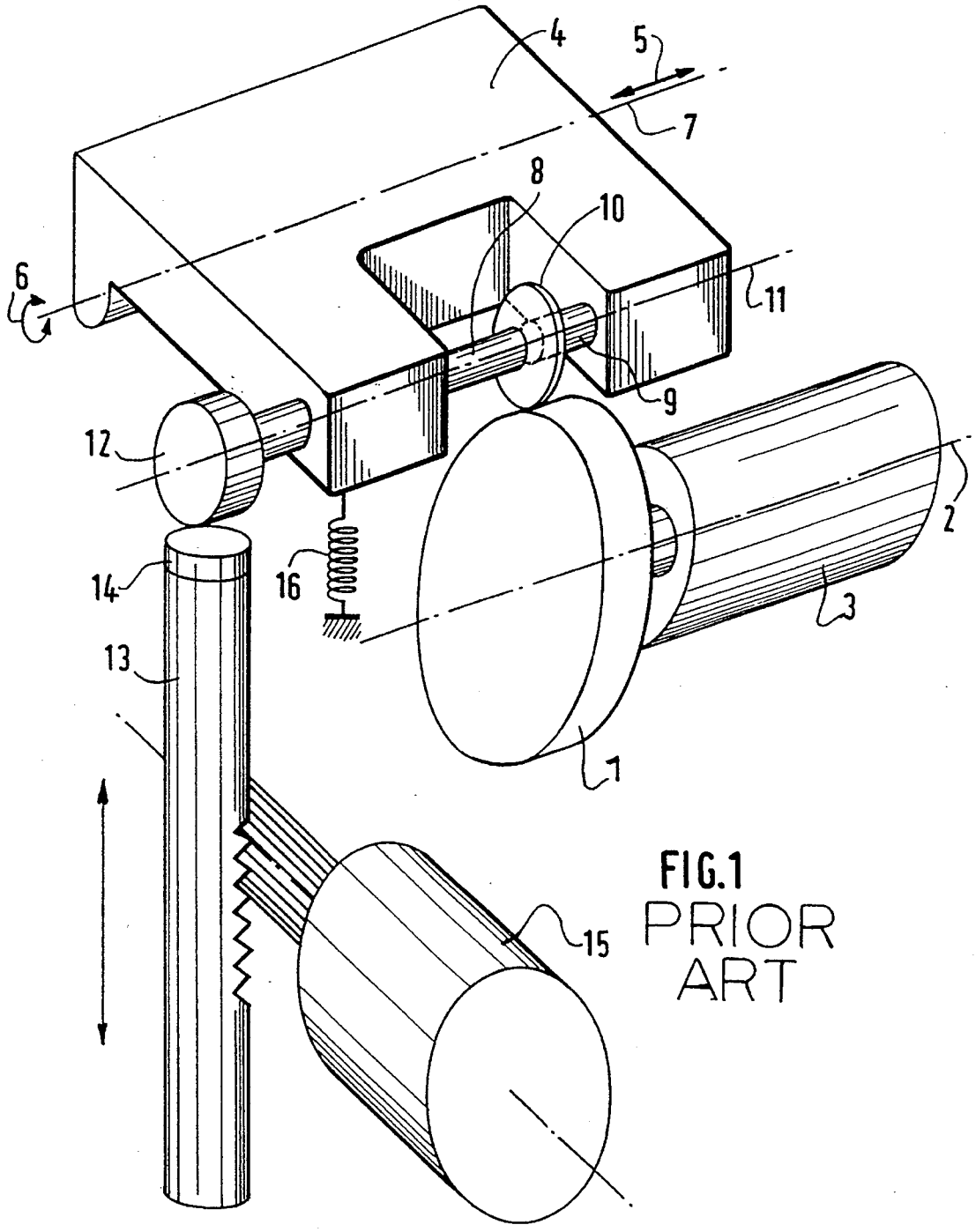
FIG. 1 is a diagrammatical view of a known grinding machine in accordance with the prior art.

FIG. 1 is a diagrammatical view of a known grinding machine in accordance with the prior art. The frame of the machine is not shown. The machine comprises a train of grinding wheels 1 driven in rotation about grinding wheel axis 2 by motor 3. The machine further includes a swinging head frame 4, slidably mounted (see arrow 5) and pivoting (see arrow 6) with respect to head frame axis (7) which is parallel to grinding wheel axis 2. This head frame 4 includes gripping means 8, 9 consisting of pins adapted to hold a lens 10 and cause it to rotate about a lens axis 11 which is parallel to grinding wheel axis 2 and head frame axis 7. A disk 12 is mounted on lens axis 11 and turns simultaneously therewith. A vernier 13 provided with a feeler 14 at its end adjacent to disk 12, is disposed perpendicularly to grinding wheel axis 2, and performs movements along its longitudinal axis when driven by motor 15, the feeler 14 then coming into contact with disk 12. Finally, pressing means 16 consisting of a return spring urge lens axis 11 carrying lens 10 in head frame 4 towards grinding wheel axis 2, along the longitudinal direction of vernier 13.

During lens machining, the pressing means 13 keep lens 10 against the grinding wheel 1. When, for a given angular direction, machining of a lens is terminated, the feeler 14 of vernier 13 comes into contact with disk 12. Machining then continues at other points on the circumference of the lens until feeler 14 is in contact with disk 12 at each point on the circumference thereof.

The system shown in FIG. 1 suffers from the disadvantages discussed above.

Figure 2:
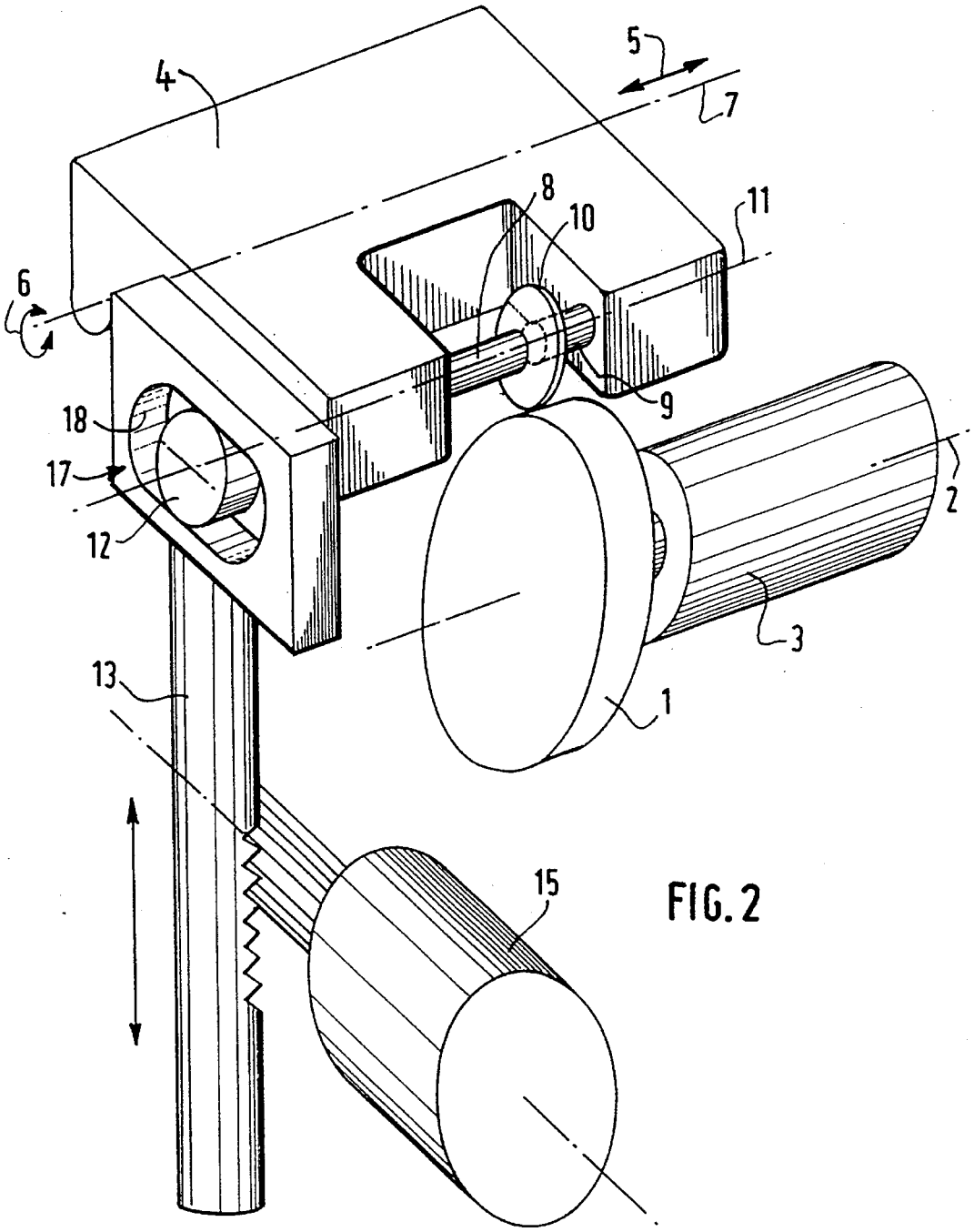
FIG. 2 shows a first embodiment of a grinding machine according to the invention.

FIG. 2 is a diagrammatical view of a first embodiment of a grinding machine according to the invention. Those parts of the machine which are identical to parts in FIG. 1 are identified by the same reference numerals and will not be described again. The grinding machine in FIG. 2 does not carry a feeler at the end of vernier 13, but rather a slotted block 17. This block 17 comprises an oblong slot 18 in which disk 12, mounted on lens axis 11, is adapted to move. Advantageously, disk 12 is replaced by a bearing mounted on the said axis. The grinding machine in FIG. 2 does not include pressing means 16. Because of this, the machine according to the invention comprises, than to the provision of the slotted block 17, a positive link between vernier 13 driven by motor 15 and head frame 4. Thus, the angular position of head frame 4 about head frame axis 7 is directly controlled by the position of vernier 13.

In a machine according to the invention, such as the one shown in FIG. 2, the movement of vernier 13 is controlled by a motor 15. The motor is controlled as a function of the angular position of gripping means 8, 9 and, consequently, as a function of the angular position of the lens during machining. Obviously, the motor 15 of vernier 13 is also controlled as a function of the shape of lens to be obtained, the shape being read from a spectacle frame by means of suitable equipment, or corresponding to a template stored in memory in the machine.

Figure 3:
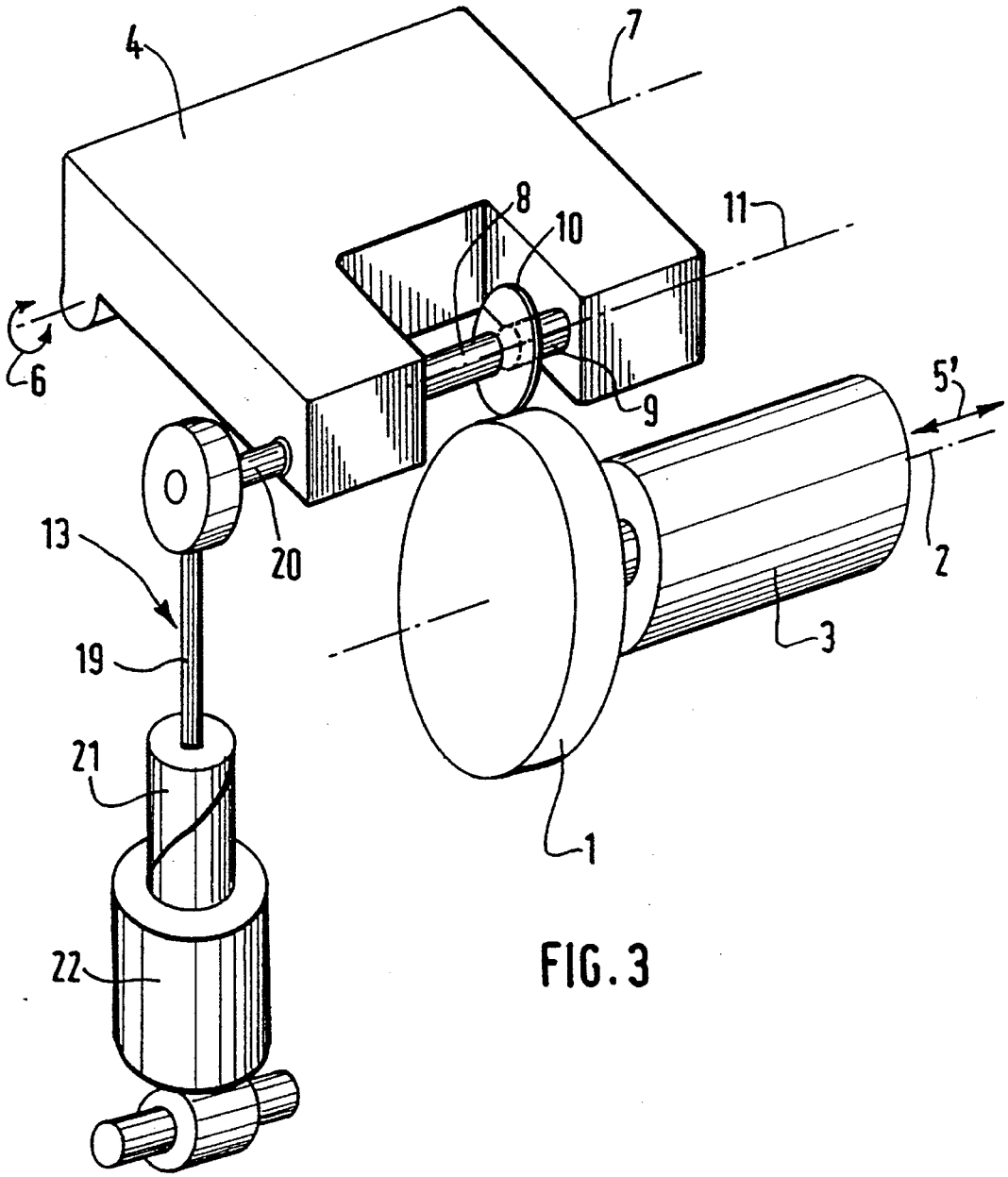
FIG. 3 shows a second embodiment according to the invention.

FIG. 3 is a diagrammatical view of a second embodiment of a grinding machine according to the invention. Parts of the machines that are similar to those in FIG. 2 are identified by the same reference numerals and will not be described again. In the machine in FIG. 3, head frame 4 only has provision for rotational movement about head frame axis 7, as shown by arrow 6. The complete assembly consisting of grinding wheel train 1 and grinding wheel motor 3 is, on the other hand, adapted to move along grinding wheel axis 2, as shown by arrow 5'. In the embodiment in FIG. 3, the vernier consists of a rod 19 linked to one end of head frame 4 by a swivel joint pivoting on a shaft 20 fixed to the head frame. The other end of rod 19 is connected to a coaxial screw jack means 21. The screw jack means is fitted inside a motor 22 adapted to rotate it. Motor 22 is mounted on the frame of the grinding machine via a swivel joint able to pivot about an axis parallel to shaft 20 and to axes 7, 11 and 2 (see FIG. 3).

The device in FIG. 3 operates substantially in the same way as the one shown in FIG. 2. Motor 22 is controlled just like motor 15, as a function of the shape of the lens to be obtained. Rotation of screw jack means 21 due to operation of motor 22 leads to a variation in length of the vernier constituted by rod 19, screw 21 and motor 22. Thus, the distance between the swivel joint connecting the rod to the head frame and the swivel joint connecting motor 22 to the frame of the machine varies as a function of the shape of lens to be obtained, this controlling the position of head frame 4 as it pivots about head frame axis 7.

The invention makes it possible to eliminate all play about head frame axis 7, and thus to prevent rebound, vibrations and other phenomena harmful to lens machining. Moreover, the invention enables the force with which lens 10 is pressed against grinding wheel 1 to be regulated by controlling the respective torque of motors 3 and 15 or 22. In this way, the invention makes it possible to vary the force with which the lens is pressed against the grinding wheel, as a function of the various phases in the machining operation. A much higher load than that employed in known systems can be used without the need for counterweights or a spring. The pressing force can vary at different phases in machining. Thus, it is possible to apply a high load to the lens during edging, enabling machining time to be reduced without endangering the final accuracy of the lens. If it is desired to modulate the force with which the lens presses on the grinding wheel, it is possible to control the torque of motor 15 or 22 of the vernier as a function of the torque of motor 3 used to drive the grinding wheels. In this way, any possibility of the motor driving the grinding wheels coming to halt is avoided, and machining is faster.

Variation in the pressing load is advantageously modulated as a function of lens thickness. A device enabling lens thickness at the peripheral portion thereof to be measured is described in the applicant's U.S. Pat. No. 4,596,091 cited above. The device consists of a reading station having two feelers constituting sensors which are applied to the faces of the lens to be machined. In the case of a thin glass, it is then possible, according to the invention, to reduce the urging action applied to the head frame thus limiting the risk of breaking the lens. Motor 15 or 22, which determine the position of vernier 13, is controlled taking account of data supplied by the two sensors. Thus, the position of the head frame takes account of the lens thickness, and it is possible to apply a higher load to thick glass, and a much lower load to thin glass.

At the finishing stage of the lens, whether this involves bevelling or grooving, it is possible to vary the pressure of the lens on the grinding wheel as a function of the force required. For example, it is possible to increase the pressure and reduce the speed of rotation of the lens at plane portions of the lens circumference. Similarly, the pressure can be reduced and the lens rotations speed increased at the corners; such control enables much more accurate machining of the lens shape to be achieved. Such control is easily obtained in accordance with the invention by controlling the motor 15 or 22 which determine the position of vernier 13, and thus, via the positive link, the position of head frame 4.

The diagrams shown in FIGS. 2 and 3 only show some possible embodiments of the invention suitable for ready implementation on existing lens grinding machines. Other embodiments of the invention can obviously be provided. In particular, disk or bearing 12 in the embodiment shown in FIG. 2 is not necessarily integral with shaft 11 supporting lens 10, and may equally well be carried on a shaft that is offset with respect to the axis 11 of the lens, as in the embodiment shown in FIG. 3. In the case of a machine in which the head frame is mounted in cantilever fashion, the slot in part 17 need not necessarily be oblong in shape. In the embodiment in FIG. 2, the oblong slot allows head frame 4 to rotate while the vernier remains parallel to its axis. Moreover, the thickness of slotted part 17 allows the head frame to move axially without the danger of losing the positive link between vernier 13 and head frame 4. In the embodiment shown in FIG. 3, these characteristics are replaced by a swinging movement of the complete vernier assembly 13.

The present invention is obviously not limited to the embodiments described and illustrated but may undergo modifications available to those skilled in the art without this leading to a departure from the scope of the invention as claimed.

What is claimed is:

1. A machine for grinding ophthalmic lenses comprising:

at least one grinding wheel rotatably mounted on a grinding wheel axis and drivable by a motor, a swinging head frame pivotally mounted on a head frame axis parallel to said grinding wheel axis, said swinging head frame comprising means for gripping and retaining an ophthalmic lens and causing said lens to rotate about a lens axis, said head frame axis being located with respect to said grinding wheel axis so that said swinging head frame is able to bring said ophthalmic lens in contact with said at least one grinding wheel, a vernier for controlling the angular position of said swinging head frame with respect to said head frame axis, said vernier being connected to said swinging head frame by means of a positive linkage, said vernier controlling the angular position of said swinging head frame through said positive linkage by undergoing movements substantially along a longitudinal axis of said vernier, as a function of the angular position of said gripping means with respect to said lens axis.

2. The grinding machine according to claim 1, wherein said head frame is able to slide along said head frame axis and said positive linkage determines the angular position of said head frame during sliding movement thereof along said head frame axis.

3. The grinding machine according to claim 1 wherein said positive linkage includes a slotted part incorporating an oblong slot in which a disk mounted on said head frame engages.

4. The grinding machine according to claim 3, wherein said disk is mounted on the axis of said gripping means.

5. The grinding machine according to claim 3, wherein said disk moves inside said slotted part during sliding motion of said head frame along said head frame axis.

6. The grinding machine according to claim 4, wherein said disk moves inside said slotted part during sliding motion of said head frame along said head frame axis.

7. The grinding machine according to claim 1, wherein the movement of said vernier is determined by a motor controlled as a function of the angular position of said gripping means and the shape to be imparted to said lens.

8. The grinding machine according to claim 7, wherein the torque of said motor driving said vernier is regulated as a function of the torque of said motor driving said grinding wheels.

9. The grinding machine according to claim 7 further comprising means for evaluating the thickness of said lens, wherein the movement of said motor driving said vernier is controlled as a function of data sent by said evaluation means.

10. The grinding machine according to claim 8 further comprising means for evaluating the thickness of said lens, wherein the movement of said motor driving said vernier is controlled as a function of data sent by said evaluation means.

11. The grinding machine according to claim 1; wherein said vernier comprises a rod linked at one of the ends thereof to said head frame, a screw jacking means linked to the other end of said rod, and a motor adapted to drive said screw jacking means.

12. The grinding machine according to claim 11, wherein said motor adapted to drive said screw jacking means is mounted on the frame of said grinding machine by a swivel joint able to pivot about an axis parallel to the axis of said head frame, the axis of said grinding wheel and the axis of said lens.

13. The grinding machine according to claim 11, wherein the end of said rod is linked to said head frame by a swivel joint pivoting about a shaft fixed to said head frame.

14. The grinding machine according to claim 12, wherein the end of said rod is linked to said head frame by a swivel joint pivoting about a shaft fixed to said head frame.

15. The grinding machine according to claim 11, wherein said motor adapted to drive said screw jacking means is controlled as a function of the angular position of said gripping means and the shape to be imparted to said lens.

16. The grinding machine according to claim 11, wherein the torque of said motor driving said screw jacking means is regulated as a function of the torque of said motor driving said grinding wheels.

17. The grinding machine according to claim 16, wherein the torque of said motor driving said screw jacking means is regulated as a function of the torque of said motor driving said grinding wheels.

18. A machine for grinding ophthalmic lenses comprising:

at least one grinding wheel rotatably mounted on a grinding wheel axis and driven by a motor, a swinging head frame pivotally mounted on a head frame axis parallel to said grinding wheel axis, said swinging head frame comprising means for gripping and retaining an ophthalmic lens and causing said lens to rotate about a lens axis, said head frame axis being located with respect to said grinding wheel axis so that said swinging head frame is able to bring said ophthalmic lens in contact with said at least one grinding wheel, a vernier for controlling the angular position of said swinging head frame with respect to said head frame axis, said vernier being connected to said swinging head frame by means of a linkage, said vernier controlling the angular position of said swinging head frame such that said head frame is substantially prevented from angular movement about said head frame axis relative to said vernier by undergoing movements substantially along a longitudinal axis of said vernier, as a function of the angular position of said gripping means with respect to said lens axis.

* * * * *